US006274002B1

(12) United States Patent
Rulis et al.

(10) Patent No.: US 6,274,002 B1
(45) Date of Patent: Aug. 14, 2001

(54) PAPERMAKING MACHINE WITH VARIABLE DEWATERING ELEMENTS INCLUDING VARIABLE PULSE TURBULATION BLADES ADJUSTED BY COMPUTER CONTROL SYSTEM IN RESPONSE TO SENSORS OF PAPER SHEET CHARACTERISTICS

(75) Inventors: Dean A. Rulis; Robert E. Edwards, Jr., both of Banks, OR (US)

(73) Assignee: Wilbanks International, Inc., Hillsboro, OR (US)

( * ) Notice: Subject to any disclaimer, the term of this patent is extended or adjusted under 35 U.S.C. 154(b) by 0 days.

(21) Appl. No.: 09/340,551

(22) Filed: Jun. 28, 1999

Related U.S. Application Data

(63) Continuation-in-part of application No. 09/103,511, filed on Jun. 23, 1998, now abandoned.

(51) Int. Cl.[7] ..... D21F 1/54

(52) U.S. Cl. ..... 162/352; 162/354; 162/374; 162/DIG. 10

(58) Field of Search ..... 162/351, 352, 162/354, 374, 198, DIG. 10, DIG. 11

(56) References Cited

U.S. PATENT DOCUMENTS

| | | | |
|---|---|---|---|
| 2,922,475 | 1/1960 | Alexander | 162/252 |
| 3,323,982 | 6/1967 | Hill | 162/352 |
| 3,936,665 | 2/1976 | Donoghue | 235/51.3 |

(List continued on next page.)

FOREIGN PATENT DOCUMENTS

| | | |
|---|---|---|
| 1-260091 | 4/1988 | (JP) . |
| WO 87/06633 | 11/1987 | (WO) . |

OTHER PUBLICATIONS

Roecker, A.C., *Evaluation of Fourdrinier Foil Designs*, Tappi, vol. 48, No. 7, Jul. 1965, pp. 109A–112A.

Thorp, B.A., *Hydrofoil Design and Application is an Evolving Science*, Paper Trade Journal, vol. 149, No. 2, Jan. 11, 1965, pp. 37–41.

*Primary Examiner*—Dean T. Nguyen
(74) *Attorney, Agent, or Firm*—Klarquist Sparkman Campbell Leigh & Whinston, LLP

(57) ABSTRACT

An automatic control system for a papermaking machine having a plurality of variable dewatering devices with moveable elements which engage the conveyor carrying the paper stock and are adjusted by electrical operating devices, such as servo motors or solenoid valves, to vary their water removal rate in response to control signals produced by a computer controller. A plurality of sensors are spaced along the path of the paper sheet downstream from the variable dewatering devices to sense the paper sheet characteristics including light transparency and mass, and to apply sensor output signals corresponding thereto to the computer controller. The servo motors have their shafts coupled to adjustment devices for cam mechanisms which adjust the moveable elements of the variable dewatering elements. The variable dewatering elements include a variable angle foil, a variable height blade, a variable width slot Uhle box, a variable width pickup device, and a variable pulse turbulation blade, whose moveable elements are adjusted to change their water removal rates. Shaft position encoders on the servo motors or other operating devices produce feedback position signal which are applied to inputs of the computer controller to indicate when the moveable elements reach their desired adjustment positions. A variable pulse turbulation blade with an adjustable in-going angle is provided with a cam-operated adjustment device that maintains the blade height constant while adjusting the in-going angle to prevent fiber clumps and to provide the paper sheet with a more uniform consistency.

12 Claims, 9 Drawing Sheets

U.S. PATENT DOCUMENTS

| | | | |
|---|---|---|---|
| 4,086,130 | 4/1978 | Justus | 162/123 |
| 4,088,531 | 5/1978 | Lamminen | 162/352 |
| 4,191,612 | 3/1980 | Araoka | 162/352 |
| 4,278,497 | 7/1981 | Mellen | 162/252 |
| 4,280,869 | 7/1981 | Eckerdt | 162/252 |
| 4,289,964 | 9/1981 | Baker | 250/308 |
| 4,319,957 | 3/1982 | Bartelmuss | 162/352 |
| 4,334,958 | 6/1982 | Baluha | 162/352 |
| 4,416,731 | 11/1983 | Pesonen | 162/308 |
| 4,443,298 | 4/1984 | Thorp | 162/252 |
| 4,559,105 | 12/1985 | Sennett | 162/352 |
| 4,684,441 | 8/1987 | Ibrahim | 162/198 |
| 4,789,431 | 12/1988 | Typpo | 162/263 |
| 5,074,966 | 12/1991 | Koivaranta | 162/301 |
| 5,129,992 | 7/1992 | Schiel | 162/352 |
| 5,169,500 | 12/1992 | Mejdell | 162/352 |
| 5,262,009 | 11/1993 | Schiel | 162/352 |
| 5,262,010 | 11/1993 | Bubik et al. | 162/352 |
| 5,300,193 | 4/1994 | Rule et al. | 162/198 |
| 5,314,581 | 5/1994 | Lin et al. | 162/263 |
| 5,421,961 | 6/1995 | Miller | 162/252 |
| 5,486,270 | 1/1996 | Schiel | 162/352 |
| 5,489,365 | 2/1996 | Wahlstrom | 162/301 |
| 5,552,021 | 9/1996 | Ilvespaa et al. | 162/203 |
| 5,622,602 | 4/1997 | Yakabe et al. | 162/252 |
| 5,660,689 | 8/1997 | Bartelmuss | 162/352 |
| 5,685,955 | 11/1997 | Leigraf et al. | 162/198 |
| 5,853,543 | 12/1998 | Hu | 162/198 |

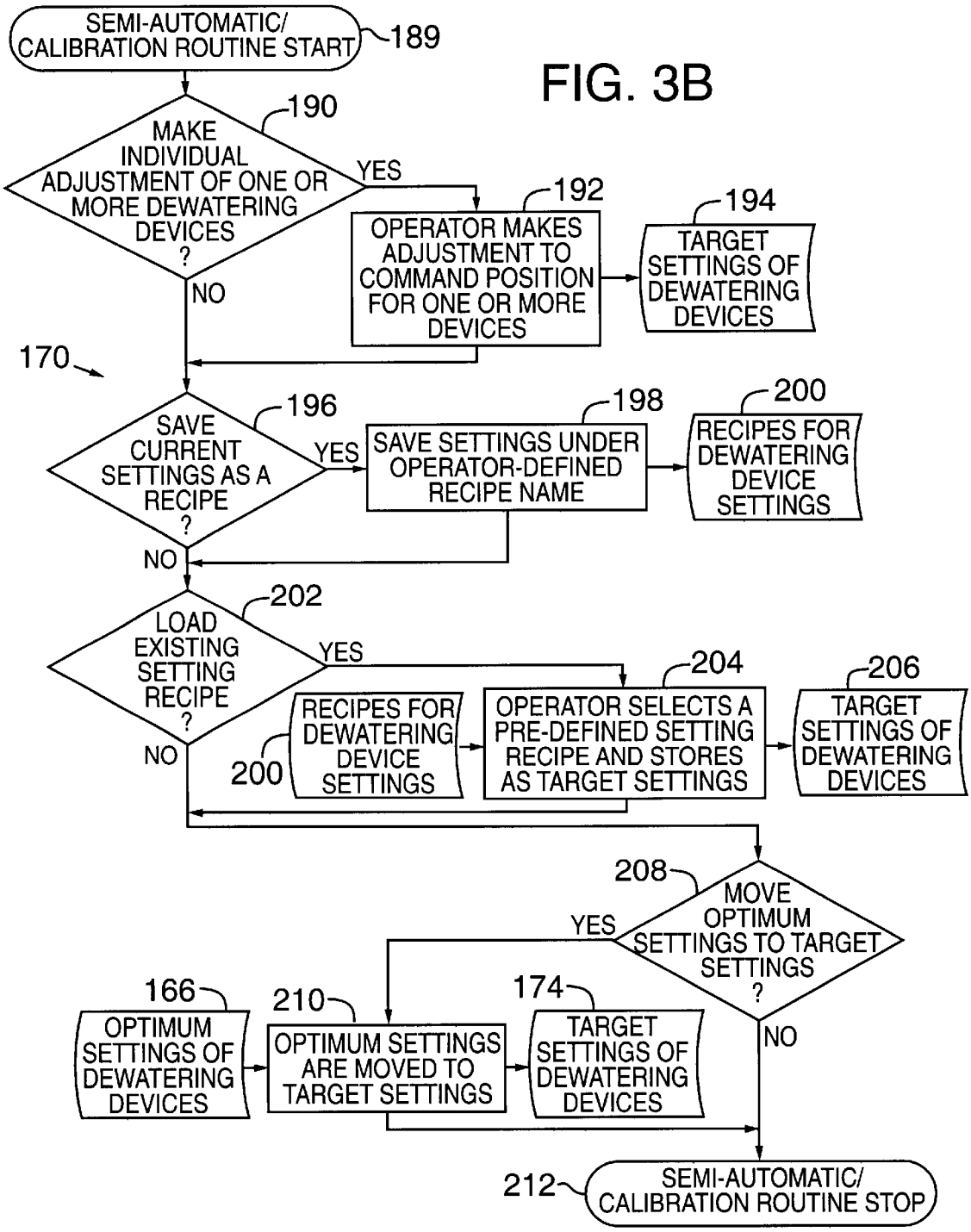
SEMI-AUTOMATIC/ CALIBRATION ROUTINE START
189
FIG. 3B
190
MAKE INDIVIDUAL ADJUSTMENT OF ONE OR MORE DEWATERING DEVICES ?
YES
192
OPERATOR MAKES ADJUSTMENT TO COMMAND POSITION FOR ONE OR MORE DEVICES
194
TARGET SETTINGS OF DEWATERING DEVICES
NO
170
196
SAVE CURRENT SETTINGS AS A RECIPE ?
YES
198
SAVE SETTINGS UNDER OPERATOR-DEFINED RECIPE NAME
200
RECIPES FOR DEWATERING DEVICE SETTINGS
NO
202
LOAD EXISTING SETTING RECIPE ?
YES
204
OPERATOR SELECTS A PRE-DEFINED SETTING RECIPE AND STORES AS TARGET SETTINGS
206
TARGET SETTINGS OF DEWATERING DEVICES
NO
200
RECIPES FOR DEWATERING DEVICE SETTINGS
208
MOVE OPTIMUM SETTINGS TO TARGET SETTINGS ?
YES
NO
166
OPTIMUM SETTINGS OF DEWATERING DEVICES
210
OPTIMUM SETTINGS ARE MOVED TO TARGET SETTINGS
174
TARGET SETTINGS OF DEWATERING DEVICES
212
SEMI-AUTOMATIC/ CALIBRATION ROUTINE STOP

PAPERMAKING MACHINE WITH VARIABLE DEWATERING ELEMENTS INCLUDING VARIABLE PULSE TURBULATION BLADES ADJUSTED BY COMPUTER CONTROL SYSTEM IN RESPONSE TO SENSORS OF PAPER SHEET CHARACTERISTICS

REFERENCE TO RELATED APPLICATION

The present patent application is a continuation-in-part of U.S. patent application Ser. No. 09/103,511 filed Jun. 23, 1998 now abandoned.

FIELD OF THE INVENTION

The present invention relates generally to papermaking machines having automatic control systems, and in particular to control systems and methods of operating papermaking machines with variable dewatering elements, including variable pulse turbulation blades, which are adjusted by the control system in response to output signals of sensors of paper sheet characteristics spaced along the path of the paper sheet downstream from the dewatering elements to make a paper sheet of improved characteristics.

BACKGROUND OF THE INVENTION

It has previously been proposed in U.S. Pat. No. 3,936,665 of Donoghue, issued Feb. 3, 1976, to provide an automatic computer operated control system for a papermaking machine including a plurality of sensors spaced laterally across the width of the paper sheet to provide a more uniform width characteristic in the paper sheet by adjusting the paper stock valve in the head box of such papermaking machine. U.S. Pat. No. 5,300, 193 of Rule et al., issued Apr. 5, 1994, discloses a method for controlling the paper machine stock pond consistency at the top forming roll by adjusting the vacuum pressure of a suction box in response to control signals produced by a sensor of the mass flow rate of the stock pond positioned between the forming roll and the suction box. However, unlike the present invention, this automatic control system does not employ a computer control system for adjusting a plurality of variable dewatering devices having moveable elements which engage the conveyor for the paper sheet to vary their water removal rate in response to sensors of the paper sheet characteristics spaced longitudinally along the path of the paper sheet at positions downstream from the dewatering elements.

U.S. Pat. No. 4,443,298 of Thorp, issued Apr. 17, 1984, shows a papermaking machine having hydrofoil blades and an automatic control for adjusting the width of the slot between adjacent hydrofoil blades to control the turbulence of the paper stock liquid adjacent the head box. Light sensors including light emitters which transmit light beams across the width of the paper stock to light detectors on the other side of the paper stock are used to sense the turbulence of the paper stock produced by the hydrofoil blades. The present computer control system adjusts dewatering elements to vary their water removal rate in response to the paper sheet sensor output signals in order to produce a paper sheet of improved characteristics. Unlike the present invention, this patent does not show an automatic control system for a papermaking machine including a plurality of paper sheet characteristic sensors which are spaced along the path of the paper sheet downstream from the dewatering elements. Instead, this patent is concerned with controlling the intensity or force of the turbulence of the paper stock or furnish prior to formation of the paper sheet by adjusting the position of the hydrofoil blades immediately adjacent the head box.

U.S. Pat. No. 5,421,961 of Miller, issued Jun. 6, 1995, shows a computer control system for adjusting the position of a forming board to a parallel position adjacent the output of the head box of a papermaking machine. The control system senses the position of the forming board with a transducer which detects the movement of a magnet attached to the forming board. Thus, unlike the control system of the present invention, this patent does not employ sensors spaced along the path of the paper sheet to sense the characteristics of the paper sheet and apply output signals to cause the control system to produce control signals which adjust dewatering elements in the papermaking machine for controlling the water removal rate and thereby changing the paper sheet characteristic being sensed.

U.S. Pat. No. 4,278,497 of Mellen, issued Jul. 14, 1981, U.S. Pat. No. 4,280,869 of Eckerdt, issued Jul. 28, 1981, and U.S. Pat. No. 5,169,500 of Mejdell, issued Dec. 8, 1992 all show paper sheet dewatering elements which are adjusted to vary the width between adjacent blades which contact the underside of the conveyor carrying the paper sheet or to adjust the angle of a foil contacting the underside of the conveyor to control the water removal rate of the dewatering element. However, these dewatering elements are not automatically controlled by control systems including sensors which sense the paper sheet characteristics being measured, but instead are controlled by sensors which sense the vacuum produced in a suction box having the adjustable dewatering device mounted thereon or by manual adjustment of the foil angle.

SUMMARY OF THE INVENTION

It is therefore one object of the present invention to provide an improved automatic control system and method of operating a papermaking machine in which a plurality of dewatering elements are adjusted in response to the output signals of sensors spaced longitudinally along the path of the paper sheet downstream from the dewatering elements for sensing the paper sheet characteristics and thereby control the water removal rate of the dewatering elements in order to provide a paper sheet of improved characteristics.

Another object of the present invention is to provide such an control system and method in which the dewatering devices have moveable elements which engage the surface of the conveyor carrying the paper stock to control the water removal rate with adjusting mechanisms which are adjusted by electrical operating devices in response to control signals in a fast and accurate manner.

A further object of the invention is to provide such a control system and method in which the dewatering devices each have at least one moveable blade which is moved by its associated operating device in response to the control signal for automatic adjustment of the water removal rate of such dewatering device.

An additional object of the present invention is to provide such a control system in which the dewatering device includes a moveable blade which is adjusted in height relative to the conveyor of the paper sheet or adjusted to change the width of the slot between adjacent blades by its operating device in response to a control signal produced by the control system.

Another object of the invention is to provide a variable pulse turbulation blade having an in-going angle relative to the conveyor which is adjustable to provide a more uniform paper sheet for different grades of paper.

Still another object of the invention is to provide such a control system in which the dewatering device includes a foil blade whose foil angle relative to the conveyor is adjusted by an electrical operating device in response to a control signal produced by the control system.

A still further object of the present invention is to provide such an improved control system in which the operating devices each produce a position signal which corresponds to the position of the moveable element it is adjusting for more accurate control.

Other objects and advantages of the present invention will be apparent from the following detailed description of a preferred embodiment thereof and from the attached drawings.

BRIEF DESCRIPTION OF THE DRAWINGS

FIGS. 3A and 3B show the flow chart of a computer program which can be employed to operate a computer control system of FIG. 2;

DETAILED DESCRIPTION OF PREFERRED EMBODIMENTS

Figure 1:
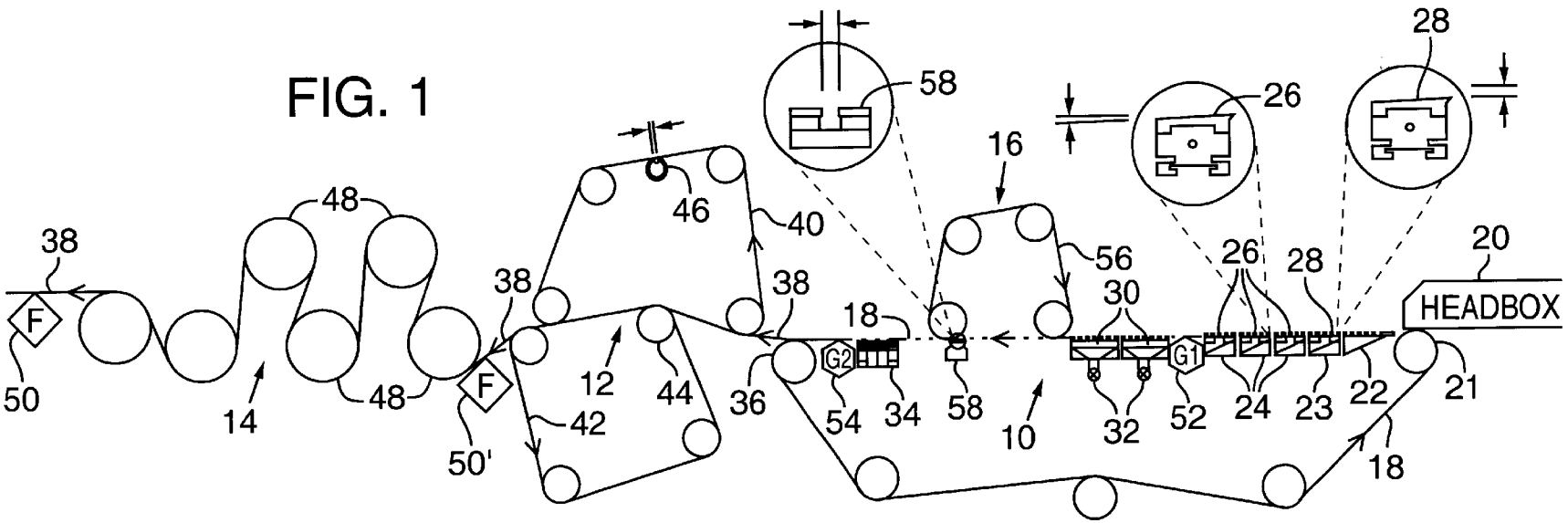
FIG. 1 is a schematic view of a papermaking machine showing the location of variable dewatering devices and paper sheet characteristic sensors which are operated by the control system of the present invention.

As shown in FIG. 1, a papermaking machine includes a forming section 10 where the paper sheet is formed from a liquid slurry of paper pulp and water known as paper stock, a press section 12 where additional water is removed from the paper sheet by pressing it against a felt sheet which acts as a blotter to absorb moisture, and a dryer section 14 where the paper sheet is dried and finished. In addition, the forming section 10 may be provided with a top surface finishing section 16 where a special finish is provided on the top surface of the paper sheet. The forming section 10 includes a porous conveyor belt 18 in the form of a woven screen or "wire" which may be made of stainless steel, bronze, or other suitable metal, or of a woven fabric of synthetic plastic such as polyester. A liquid slurry of paper pulp and water referred to as "paper stock" is supplied from the output of a head box 20 onto the upper surface of the conveyor wire 18 driven over a breast roll 21 which transports it across the surface of a forming board 22 and a dewatering table 23. The paper sheet is formed on such forming board and dewatering table in a conventional manner and such paper sheet is then conveyed across the surface of a plurality of gravity boxes 24 having variable angle foils 26 provided on their upper surface. In addition, the gravity boxes of dewatering table 23 may be provided with variable turbulation blades 28, such as variable height turbo blades, which provide turbulence to the paper stock during formation of the paper sheet and are adjusted in height relative to the bottom surface of the conveyor wire. Both the variable angle foils 26 and the variable height blades 28 are dewatering devices which remove water from the paper sheet as it is formed and conveyed across these elements. The variable angle foils 26 each engage the bottom surface of the conveyor at a small foil angle preferably in the range of about zero to four degrees, which produces a vacuum below the conveyor belt that sucks water from the paper sheet. Adjustment of this foil angle controls the water removal rate of the foil and such removed water then drains through the gravity boxes 24 and is disposed of. The variable height blade 28 is spaced from blades on either side of such blade which are at different heights relative to the conveyor 18 in order to provide an undulation and turbulence of the paper stock to form the paper sheet and to assist in removing water therefrom.

Next the paper sheet passes from the variable angle foils 26 across the upper surface of suction boxes 30 which have fixed blades that engage the conveyor wire and are spaced apart by slots to allow water to drain from the paper sheet as it is conveyed across the suction boxes 30. The vacuum of the suction boxes 30 may be changed to vary their water removal rate by adjusting vacuum control valves 32 on such suction boxes. The conveyor transports the paper sheet over a final suction box 34 and around a suction couch roll 36 at the output of conveyor 18 from which the paper sheet 38 is transferred into the press section 12.

A conveyor felt 40 of an endless sheet of water absorbing blotter type woven felt material engages the upper surface of the paper sheet 38. The paper sheet is pressed between conveyor felt 40 and a press conveyor wire 42 of the same type material as conveyor wire 18, when the paper passes over a press roll 44. The water absorbed in the felt sheet 40 is removed by a Uhle tube vacuum box 46 which includes a pair of spaced blade elements that engage the felt and are separated by a variable slot which is adjusted by movement of one of the blades for controlling the water removal rate of such Uhle box. The paper sheet 38 is transferred from the press section 12 into the dryer section 14 where it is conveyed about dryer rolls 48 which are heated internally with steam to dry the paper sheet by evaporation due to thermal contact with such rolls. As a result, the dried paper sheet 38 is transmitted from the output of the dryer section across a transparency sensor 50 which includes a laser light source and photo detector on opposite sides of the sheet for testing the light transparency characteristic of the paper sheet. It should be noted that the transparency sensor 50 may be located alternatively at the output of the press section 12 at position 50' instead of at the output of the dryer section.

In addition, a plurality of mass sensors 52 and 54 may be provided beneath the conveyor 18 in the forming section 10 in order to determine the mass or density of the paper sheet as it is conveyed along such conveyor. The first mass sensor 52 may be positioned between the foil gravity boxes 24 and the suction boxes 30 while the second mass sensor 54 is positioned between the final suction box 34 and the couch roll 36 at the output of the forming section. These mass sensors may be gamma gauges which employ radioactive sources and detectors to measure the mass or density of the paper sheet as it passes over such sensors. The mass sensors 52 and 54 thereby determine the amount of water remaining in the sheet at the position where the sensors are located which is spaced along the conveyor downstream from the dewatering elements 26, 28, and 30 that are adjusted to control the water removal rate.

When a top surface finishing section 16 is employed on the forming section 10, a special finish conveyor 56 is provided which is urged into contact with the upper surface of the paper sheet 38 to press it against the sheet conveyor 18 in order to provide such upper surface with a desired finish. A variable slot pickup device 58 may be provided on the conveyor 18 adjacent the output of the finishing section 16 in order to force the paper sheet 38 to remain on the conveyor 18 and not be picked up by the finish conveyor 56. The variable slot pickup device 58 has a pair of blade members separated by a slot whose width may be varied by moving one of the blade members in response to control signals produced by the computer control system of FIG. 2 in a manner hereafter described.

Figure 2:
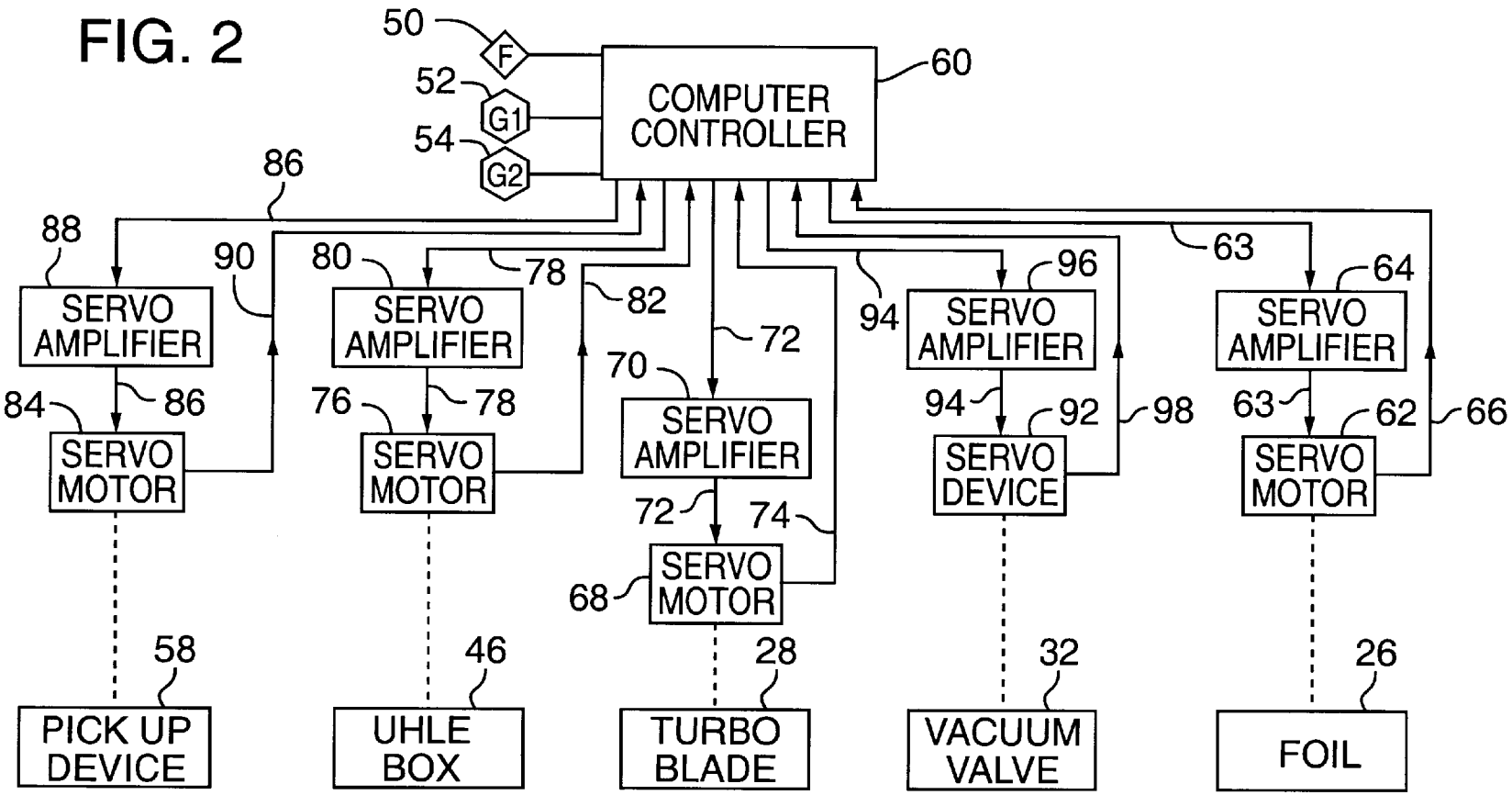
FIG. 2 is a block diagram of the control system of the present invention.

The dewatering devices including the adjustable angle foils 26, the variable height turbo blades 28, the suction boxes 30, the variable slot Uhle box 46, and the variable slot pickup device 58 each have a moveable element which is adjusted by electrical operating devices such as electric motors in response to control signals produced by the computer control system of FIG. 2 to vary their water removal rates. In addition, the vacuum valves 32 of the suction boxes 30 may also be adjusted by an electrical operating device such as a solenoid valve actuator which is controlled by the control signals of the computer to vary the vacuum within such suction boxes.

As shown in FIG. 2, the automatic control system of the present invention includes a computer controller 60 having at least three inputs connected to the outputs of sensors 50, 52, and 54 for sensing different characteristics of the paper sheet at positions spaced along the path of such sheet downstream from the dewatering devices. Thus, transparency sensor 50 senses the paper sheet's light transparency and produces a corresponding sensor output signal which is applied to an input of the computer controller. Also, mass sensors 52 and 54 sense the paper sheet mass which indicates the amount of water relative to the amount of paper fiber remaining in the sheet at the point where the sensor is located and apply corresponding sensor output signals to the controller. The computer controller sends control signals from its outputs to a plurality of electrical operating devices for adjusting a moveable element in each of the dewatering devices. The operating devices include a drive motor 62 for adjusting the angle of the variable angle foil 26 in a manner hereafter described with respect to FIGS. 4 and 5. Thus, the computer controller 60 applies a first control signal at output 63 through a servo amplifier 64 to the drive motor 62 which may be a servo motor having a shaft position encoder which produces a position output signal corresponding to the rotational position of the shaft at output 66 which is transmitted as a feedback signal back to the computer controller. As a result, the computer determines when the foil angle reaches the proper angle by detecting the rotational position of the motor shaft and stops further movement of the motor shaft such as by terminating the control signal 63 applied to motor 62. The adjustment of the foil angle by the servo motor 62 is accomplished by the cam actuator mechanism shown in FIGS. 4 and 5 as hereafter discussed.

Figure 4:
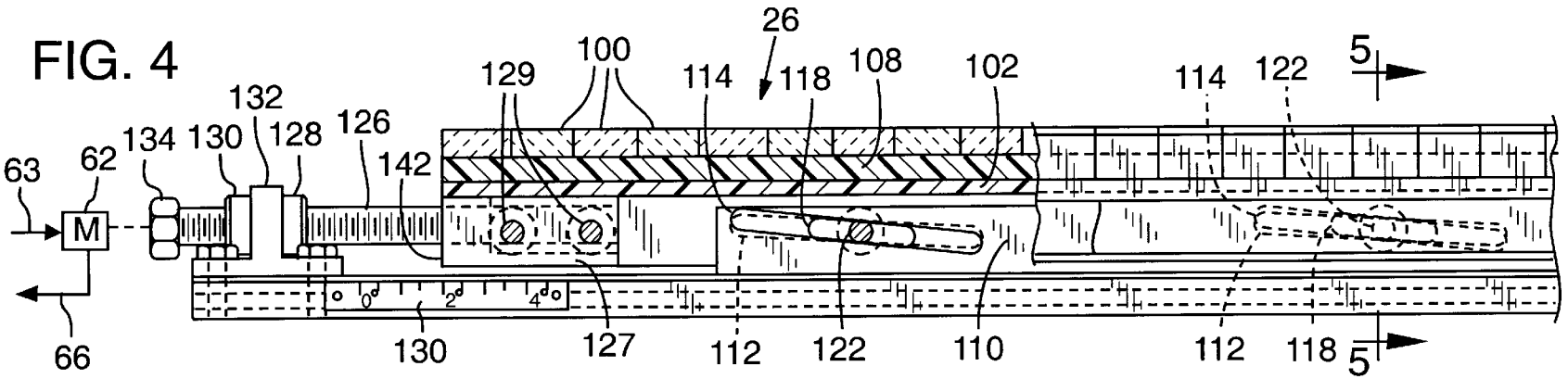
FIG. 4 is a side elevation view of an adjustable angle foil dewatering device with a cam operated adjusting mechanism which can be employed in the papermaking machine of FIG. 1 and its foil angle adjusted by the computer control system of FIG. 2.
Figure 5:
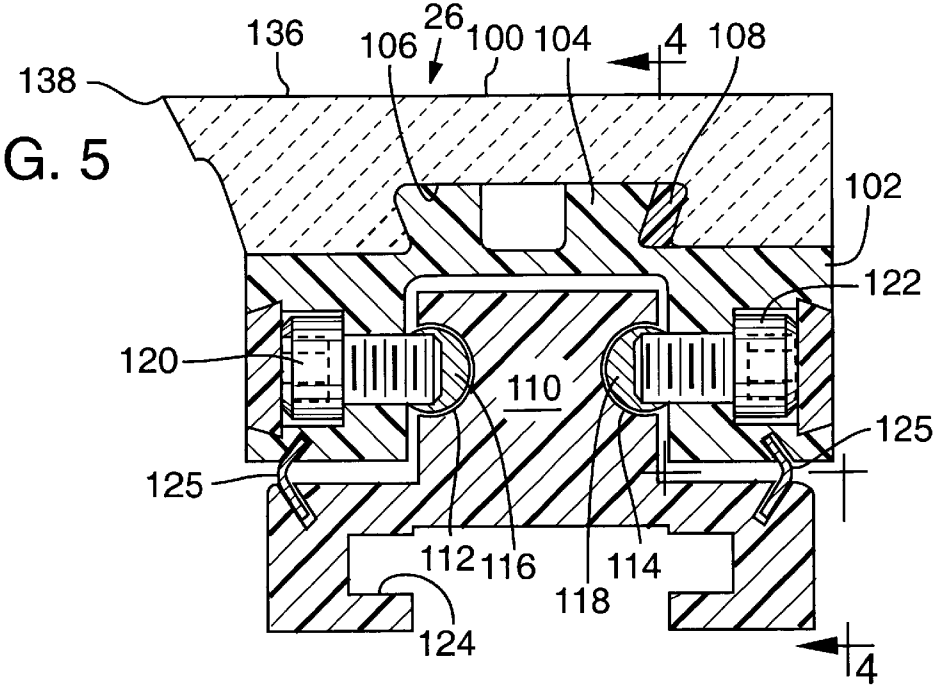
FIG. 5 is a vertical section view taken along the line 5—5 of FIG. 4.

In a similar manner, the adjustable height turbo blade 28 is controlled by a second servo drive motor 68 in response to a control signal 72 supplied by the computer controller 60 through a servo amplifier 70 to such motor. The servo motor 68 is also provided with a shaft position encoder that produces a feedback position signal 74 which is transmitted to the computer controller to indicate the rotational position of the motor shaft which corresponds to the height of the blade 28. The servo motor 68 adjusts the height of the blade 28 by means of any suitable cam mechanism in a similar manner to the cam adjustment of the foil angle of the foil 26 as shown in FIGS. 4 and 5.

A third servo drive motor 76 is used for varying the width of the slot of the Uhle box 46 by adjustment of a moveable Uhle blade in response to a control signal 78 transmitted from the computer controller 60 through a servo amplifier 80 to the drive motor. The servo drive motor 76 also has a shaft position encoder which produces a feedback position signal 82 that is fed back to the computer controller to indicate the width of the variable slot of the Uhle box. Thus, the Uhle box includes at least one moveable Uhle blade separated by a slot from another blade both of which engage the felt conveyor 40. The moveable blade is adjusted by a suitable cam actuator to vary the slot width by the operation of the drive motor 76 in a similar manner to the cam actuated variable angle foil 26.

The variable slot pickup device 58 is also provided with a moveable blade separated by a slot from a second blade which both engage the underside of the conveyor 18. The moveable blade member is adjusted to vary the slot width by a fourth servo drive motor 84 in response to a control signal 86 produced by computer controller 60 and transmitted through servo amplifier 88 to such drive motor. In addition, the drive motor 84 employs a shaft position encoder which produces a feedback position signal 90 which is transmitted back to the computer controller to indicate when the desired width of the slot of the pickup device is reached. The drive motor 84 moves the adjustable blade of the variable slot pickup device by means of a suitable cam mechanism similar to that used by the Uhle box 46 and the variable angle foil 26 as described above.

An electrically operated servo drive device 92, which may be a solenoid or drive motor, is employed to adjust each of the vacuum control valves 32 of the suction boxes 30 in order to change the vacuum in such boxes and thereby control their dewatering rates. The electrical operating device 92 is actuated by a control signal 94 supplied by the computer controller 60 through a servo amplifier 96 to the operating device 92. The operating device 92 transmits a feedback position signal 98 to the computer controller 60 which corresponds to the position of the valve.

As shown in FIGS. 4 and 5, the variable angle foils 26 each include a plurality of rigid foil segments 100 of a suitable hard wear-resistant ceramic material such as aluminum oxide, which are fixedly mounted on the top of a support base member 102 of fiberglass reinforced plastic material which extends across the conveyor 18. The support base 102 is provided with a dovetail projection 104 on the top surface thereof which extends into a dovetail slot 106 in the bottom of each of the ceramic segments 100 and is bonded thereto by a thermo-setting bonding material 108, such as epoxy resin. The foil support base 102 is attached to a separate mounting member 110 of fiberglass reinforced plastic having a plurality of downward sloping cam slots 112 and 114 formed in the opposite sides of a top portion thereof. The cam slots 112 and 114 are engaged by cam follower members 116 and 118, respectively, which are attached to the support base 102 by mounting bolts 120 and 122 extending through the front side and the rear side of the support base as shown in FIG. 5. The mounting member 110 is provided with a T-shaped slot 124 in its bottom portion for mounting on a T-bar of stainless steel or fiberglass reinforced plastic fixed to the frame of the papermaking machine and extending across the width of the paper sheet conveyor 18. Two resilient seals 125 of rubber may be provided between the base member 102 and the mounting member 110 to protect the cam mechanism from corrosive liquid. This construction is described in U.S. Pat. No. 5,169,500 of Mejdell issued Dec. 8, 1992.

As shown in FIG. 4, an actuating screw 126 is attached at its inner end to an end cap member 127 which is fixed by bolts 129 to the support base 102 in order to move such support base longitudinally along the mounting member 110 by rotation of such screw. This causes the cam followers 112 and 114 to slide along the cam slots 116 and 118, respectively, to adjust the foil angle formed between the top surface 136 of the foil 26 and the bottom of the conveyor 18. Thus, the actuating screw 126 extends through threaded stop collars 128 and 130 on opposite sides of a fixed support bracket 132 which is fixedly attached to the side of the bottom portion of mounting member 110 so that the support base 102 is moved by the screw relative to the mounting member. The outer end 134 of the adjusting screw is mechanically coupled to the drive shaft of the drive motor 62 for rotation by such motor.

It should be noted that the cam slot 112 on the front side of the mounting member 110 is of a different slope than the cam slot 114 on the back side of such mounting member as is clearly shown in FIG. 4. As a result of this, the foil member 20 pivots about the mounting member 110 to change the foil angle between the upper surface 136 of the foil and the paper sheet conveyor in contact therewith, without changing the height of the front edge 138 of the foil relative to the conveyor. A foil angle indicator scale 130 is provided on the support for the bracket 132 and an angle pointer 142 is provided by the end of the foil base member 102. As shown by scale 130 the foil angle may be adjusted in the range of zero degrees to four degrees and in FIG. 4 is set at two degrees.

The height of the adjustable turbo blade 28 on the forming table 23 may be changed relative to the conveyor 18 while maintaining the upper surface of such blade parallel to such conveyor by using a similar cam arrangement to that of FIGS. 4 and 5 except that the cam slots 112 and 114 would then have the same slopes. As a result, the height of the adjustable blade is changed uniformly along such blade relative to the other blades on opposite sides thereof. This adjusts the turbulence of the paper stock flowing over the forming table and varies the water removed from the paper sheet formed on the forming table 23. It should be noted that for adjusting the width of the slot between blades of the pickup device 58 and the slot between the blades of the Uhle box 46, the cam actuating means would be provided on a horizontal surface rather than a vertical surface of the support for such blade. One suitable cam mechanism is shown in U.S. Pat. No. 4,278,497 of Mellen issued Jul. 14, 1998 or in U.S. Pat. No. 4,280,869 of Eckerdt issued Jul. 26, 1981.

Figure 3A:
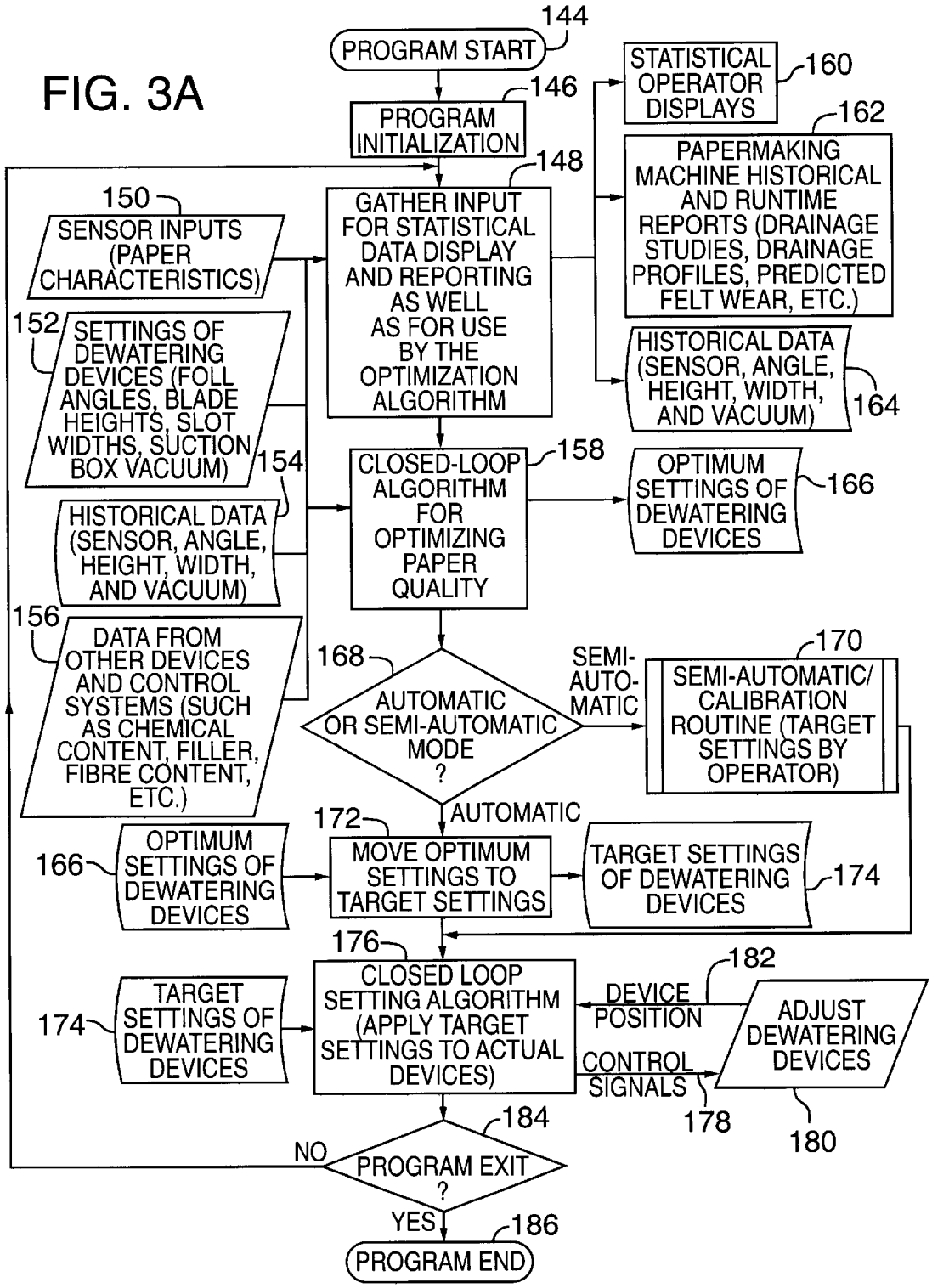

A computer program flow chart for the computer controller 60 of FIG. 2 is shown in FIGS. 3A and 3B. As shown in FIG. 3A, the flow chart of a computer program for the computer controller 60 of FIG. 2 includes a program start step 144 and a program initialization step 146 which causes a data gathering step 148 to be initiated for gathering input data from a plurality of input signal sources including paper sheet characteristics sensor inputs 150, dewatering devices settings input 152, a historical dewatering devices data source 154, and a data input 156 from other devices and control systems such as the chemical content of the paper stock employed in the head box of the papermaking machine as well as filler and fiber content of the stock. The input data from sources 150, 152, 154, and 156 are all applied to the data gathering input step 148 and are also applied to a closed loop algorithm step 158 containing a suitable algorithm for optimizing paper sheet quality. The data gathering input step 148 has one of its outputs connected to a statistical display 160 for the operator and a papermaking machine history and run-time reporting step 162 as well as a historic dewatering device and sensor data storage step 164.

The other output of the closed loop algorithm step 158 is transmitted to an optimum settings of dewatering devices step 166 which stores the optimum settings of the dewatering devices including the foil angles, blade heights, slot widths, and suction box vacuum pressure inputs supplied by step 152 when the optimum paper sheet quality has been achieved as determined by the step 158. In addition, a second output of the step 158 is supplied to an automatic or semi-automatic mode decision step 168 which determines whether the papermaking machine is operated in a fully automatic mode or a semi-automatic mode. In the semi-automatic mode the output of step 168 goes to a semi-automatic/calibration routine 170 in which the target settings of the dewatering devices are entered by the operator rather than by the computer. This semi-automatic/calibration routine 170 is shown in greater detail in the sub-routine flow chart of FIG. 3B as hereafter described.

When the automatic mode is selected, the output of the mode selection step 168 is supplied to a step 172 for moving the optimum settings of the dewatering devices stored in step 166 to the target settings step 174 which stores the target settings of such dewatering devices. In addition, step 172 produces an output which initiates a closed loop setting algorithm step 176 which applies the target settings of the dewatering devices obtained in step 174, to the actual devices in step 180 through control signal outputs 178 to adjust the dewatering devices in step 180 to the target settings of dewatering devices by moving a moveable element of each of such devices to adjust the foil angle, blade height, slot width, and suction box vacuum of such devices. The position of the moveable element of each of the dewatering devices is transmitted as device position signals 182 from the dewatering device adjustment step 180 to the close loop setting algorithm step 176 to indicate the position that the moveable element of the dewatering device has been adjusted to. When this target setting adjustment is complete, the close loop step 176 applies an output to a program exit decision step 184 which decides whether to exit the program by sending a "yes" command to the program end step 186 or sending a "no" signal back to the input data gathering step 148 which causes the program to continue.

As shown in FIG. 3B, the semi-automatic/calibration routine 170 includes a semi-automatic/calibration routine start step 188 which is actuated by the output of the mode decision step 168 of FIG. 3A. The calibration routine start step 188 applies an output to a decision step 190 for deciding whether or not to make individual adjustment of one or more dewatering devices. Thus, step 190 produces a "yes" output when an adjustment is to be made which is supplied to step 192 causing the operator to make the adjustment to the command position for one or more dewatering devices. The output of step 192 transmits the adjusted setting of the dewatering device to a target setting of dewatering device storage step 194 which stores the target settings selected by the operator. When the output of the dewatering device adjustment step 190 is "no", it applies an input to a save current setting as recipe decision step 196, which causes the current or present setting of the dewatering devices to be saved as a recipe by applying a "yes" output in a save setting step 198, which produces a setting output which is applied to a recipe for dewatering settings step 200 for saving as an operator-defined recipe the current settings of the dewatering devices. When the output of the save step 196 is "no", it actuates a load existing setting recipe step 202.

The load existing setting recipe decision step 202 has a "yes" output which actuates an operator selects step 204 in which the operator selects a pre-defined setting recipe for each of the dewatering devices and stores it as a target setting of the dewatering device in step 206. The target settings of step 206 are obtained from the recipes for dewatering device settings stored in 200. At the "no" output of the load existing setting recipe decision step 202, a move optimum target setting decision step 208 is actuated which provides a "yes" output to the optimum settings move step 210 in which the optimum settings of the dewatering devices of step 166 on the flow chart of FIG. 3A are moved to the target settings step 174 determined by the automatic mode flow chart of FIG. 3A. After this, the move optimum settings step 210 produces an output which actuates a semi-automatic/calibration routine stop step 212. Similarly, the "no" output of the move optimum settings to target settings decision step 208 actuates the calibration routine stop step 212. This completes the computer program flow chart of FIG. 3B.

In the process of making paper, a liquid mixture of water and fibrous pulp called "paper stock" is sprayed onto a porous conveyor web called the fabric. At this point the paper stock is typically more than 99% water and less than 1% wood fiber. As the paper stock travels on the conveyer fabric down the length of the papermaking machine, water is continuously being drained from the stock through the moving fabric. As a result, the paper stock begins to thicken and form a paper sheet. Without sufficient agitation to the mixture, the fiber in the paper stock tends to clump, or "flock" together. The formation of flocks in a sheet is detrimental to the uniform quality of the paper, causing an inconsistent appearance in the sheet. This is prevented by agitation of the paper stock by producing turbulence in the stock.

The conventional means of causing agitation to paper stock is by placing dewatering elements below the conveyer fabric with specific static geometry relative to the conveyer fabric to cause turbulence in the sheet.

Figure 6:
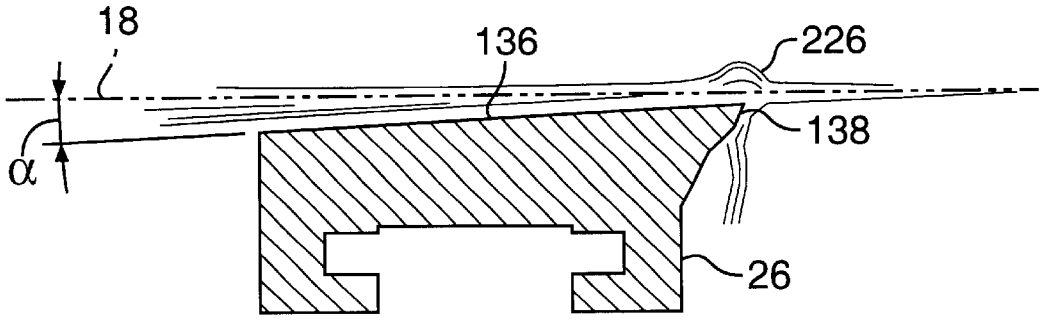
FIG. 6 (Prior Art)
FIG. 6 is a side elevation view of a prior art foil and the paper stock pulse produced by such foil.

The most common geometry is to use a prior art device known as a "foil," which supports the fabric and helps to remove water from the sheet (see FIG. 6). The basic foil has a leading edge that scrapes water off the underside of the fabric, supports the fabric and pushes a small amount of water back up into the fabric. The water that is pushed back up into the fabric causes an upward pressure stock pulse. Behind the leading edge of the foil, it is common for the flat top surface of the foil to form a diverging angle away from the conveyer fabric. This diverging angle is known as the foil angle. The foil angle causes a low-pressure area to form under the fabric, which causes water to be pulled form the sheet. This low pressure also causes a small pulse to the sheet. The pulse is the primary means to break up flocks that are trying to form in the sheet.

The above-mentioned foil works sufficiently well for most types of paper, but on some thick, heavy types of paper, a pulse of greater magnitude is required to break up the flocks. For these heavy grades, it is common to use a prior art turbo blade 28' with a fixed in-going angle β between a flat leading portion of the blade and the conveyer to get a stock pulse of a greater magnitude (see FIG. 7). The magnitude of the pulse is directly correlated to the amount of the in-going angle. By increasing or decreasing the in-going angle using turbo blades with different fixed in-going angles, the magnitude of the pulse is increased or decreased as well.

Many paper machines produce a range of paper grades. As the grades and thus the weight of the paper sheet changes, the magnitude of the pressure pulse required also changes. To date, the only way to change the magnitude of the pulse caused by the in-going angle is to change the speed of the machine or the magnitude of the in-going angle. Previously, the only way to change the in-going angle of the prior art turbo blade 28' was to remove the fixed in-going angle blade from the paper machine and replace it with another fixed-angle blade with a different in-going angle. Changing turbo blades on a paper machine is not convenient. The typical turbo blade is 200 to 400 inches long and replacement of the blade is usually done while the machine is in operation which makes replacement of the blades very difficult and time consuming.

Figure 8:
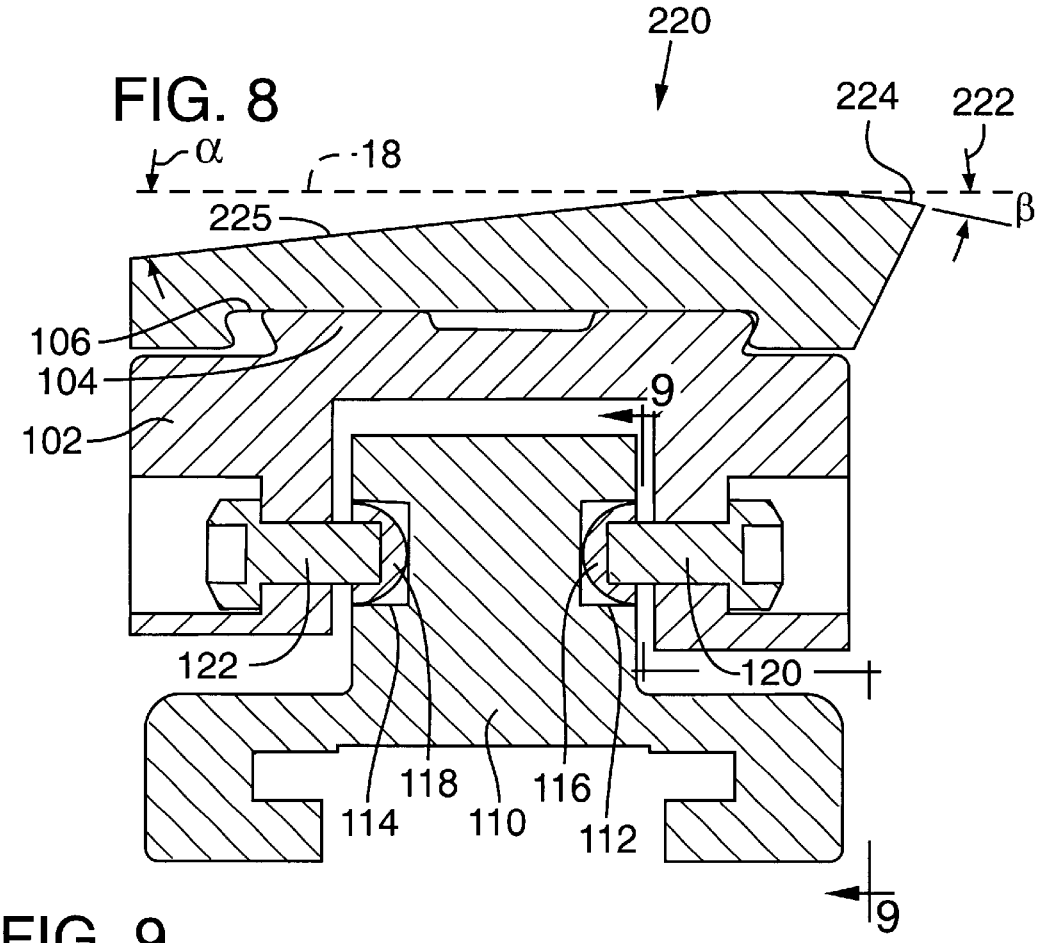
FIG. 8 is a section view of one embodiment of the variable pulse turbulation blade of the present invention.

The variable height turbo blades 28 of FIGS. 1 and 2 may be replaced by variable pulse turbulation blades 220 shown in FIG. 8 which are made in accordance with one embodiment of the present invention to provide an adjustable in-going angle β labeled 222, between a flat leading portion 224 at the front end of the top surface of such blade and the conveyor 18. The in-going angle β of the turbo blade 220 is adjusted to vary the pulse height, as hereafter discussed with reference to FIGS. 8, 9 and 10A–10D.

As shown in FIGS. 4, 5 and 6, the conventional prior art foil 26 has a flat upper surface 136 which extends rearwardly from a leading edge 138 and slopes downward away from the conveyor 18 to form a foil angle α between such upper surface and such conveyor. The foil angle produces a vacuum pressure which draws water down through the conveyor from the paper sheet carried by the conveyor. In addition, the leading edge 138 of the foil scrapes the bottom of the conveyor 18 to remove a portion of the water on its lower side draining from the paper stock, and also deflects another portion of such water upward through the conveyor to produce a small turbulation pulse 226 in the paper stock solution. This pulse creates a turbulence in such stock that tends to prevent clumps of fibers or flocks from forming in the paper sheet, thereby producing a paper sheet of more uniform consistence. However, the turbo pulse 226 is not of sufficient height to prevent flocking of many heavier grades of paper.

Figure 7:
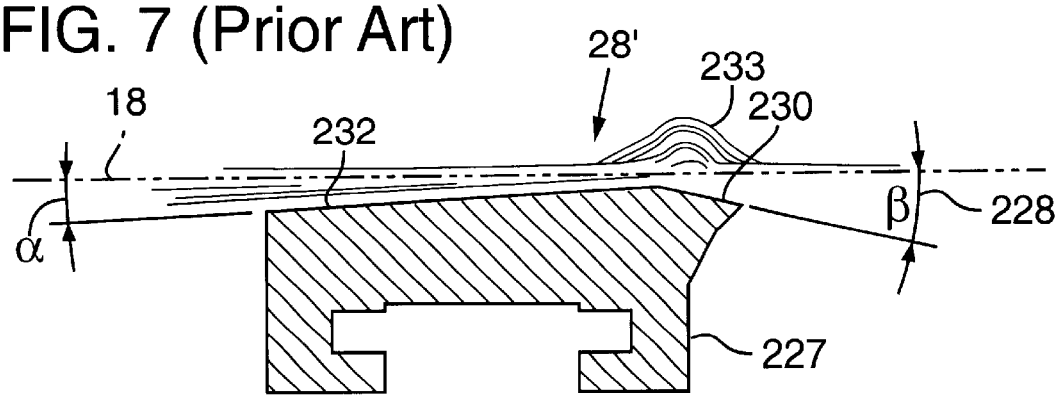
FIG. 7 (Prior Art)
FIG. 7 is a side elevation view of a prior art turbulation blade with a fixed in-going angle and the stock pulse produced by such blade.

As shown in FIG. 7, a prior art fixed turbo blade 28' has been employed with a fixed in-going angle β, labeled 228, between a flat leading portion 230 on the top surface of such blade and the conveyor 18. In addition, such prior turbo blade also functions as a foil because it has a fixed foil angle α between a flat rear portion 232 of the blade and the conveyor. This turbo blade 28' produces a higher stock pulse 233 than the stock pulse 226 produced by the conventional foil of FIG. 6. The height of the turbulence stock pulse 233 in FIG. 7 is determined by the fixed in-going foil angle 228.

However, this fixed in-going angle turbo blade 28' is not satisfactory for may different grades of paper. As a result, other fixed-turbo blades with different fixed in-going angles must be substituted for such blades with different grades of paper. This may require stopping the papermaking machine to replace the previously installed fixed-angle turbo blade with another, which is time-consuming and costly, resulting in lost paper production.

Figure 9:
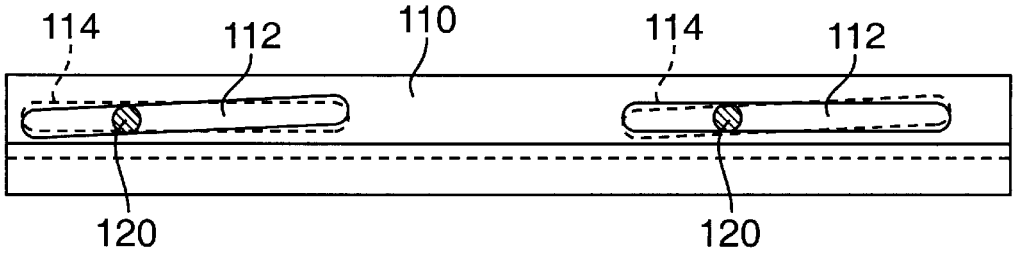
FIG. 9 is a section view of the base member taken along the line of 9—9 of FIG. 8 showing cam slots and pins in a cam operated adjusting mechanism used to vary the in-going angle of such blade.

The above problems are overcome by the variable angle turbulation blade 220 of the present invention, one embodiment of which is shown in FIGS. 8 to 10. The in-going β angle 222 of blade 220 between the flat leading surface 224 and the conveyer 18 is adjusted by the same cam adjustment mechanism used for the foil 26, shown in FIGS. 4 and 5, while maintaining the height of the blade relative to the conveyor 18 substantially constant. In this embodiment of the turbulation blade 220, the foil angle α of the blade between its flat rear surface 225 and the conveyer 18, is also adjusted when the in-going angle β is adjusted.

Four different in-going angle positions of the turbulation blade 220 are shown in FIGS. 10A to 10D. The in-going angle β is adjusted by a cam mechanism when the support member 102 fixed to the turbulation blade 220, is moved longitudinally along the base member 110 to cause the ends of cam follower pins 120 and 122 on such support member to slide along the cam surfaces within the sloping cam grooves 112 and 114, respectively, which are on opposing sides of the base member as shown in FIGS. 8 and 9. As a result, the cam mechanism adjusts both the foil angle α and the in-going angle β of the turbulence blade 220 relative to the conveyor 18 while maintaining the height of the blade relative to the conveyor substantially constant.

Figure 10A:
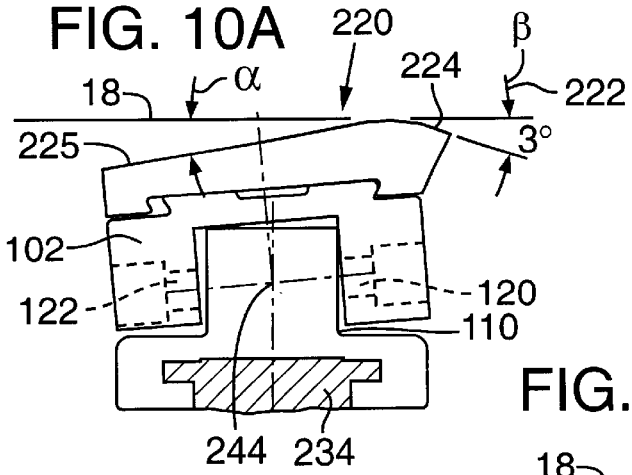
FIGS. 10A to 10D show different portions of the blade of FIGS. 8 and 9.
Figure 10B:
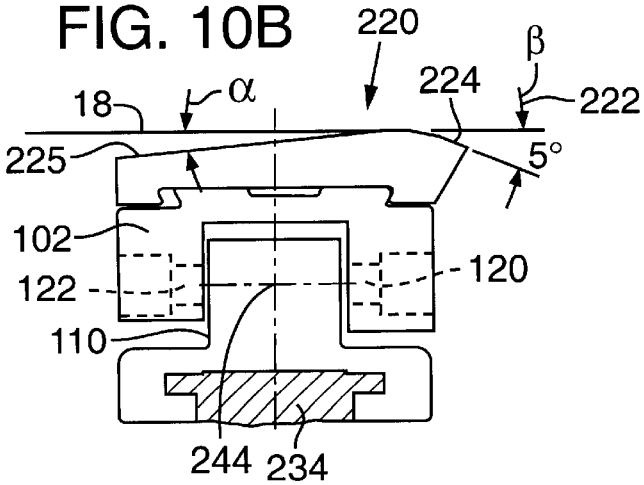
Figure 10C:
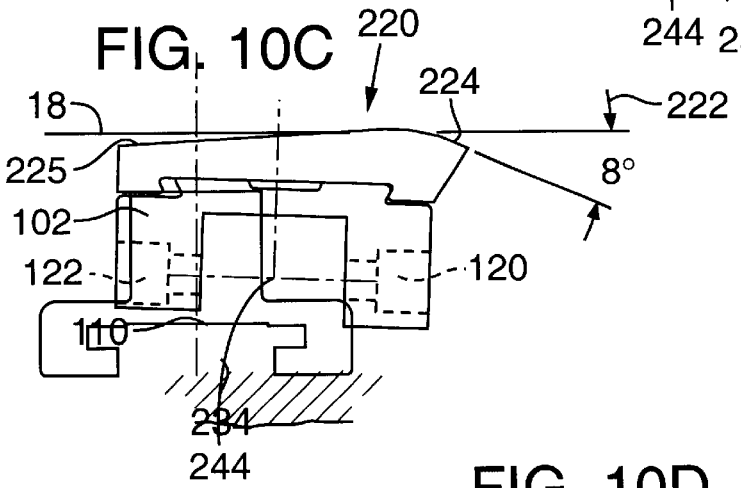

In the position of FIG. 10A, the turbo blade 220 has an in-going angle β of 3.0 degrees and a foil angle α of 10.5 degrees, and has a height of 1.665 inches above a T-bar support rail 234 on which the base member 110 is mounted by a T-shaped slot in the bottom of such base member. In FIG. 10B, the turbulation blade 220 has been pivoted about a pivot axis 244 by the cam mechanism to a second position to provide an in-going angle β of 5.0 degrees and a foil angle α of about 6.0 degrees relative to the conveyor 18. Similarly in FIG. 10C, the blade 220 has been pivoted into a third position to provide an in-going angle β of 8.0 degrees and a foil angle α of about 3.0 degrees. Finally, in FIG. 10D the turbulation blade 220 has been pivoted to a fourth position to provide an in-going angle β of 12.0 degrees and a foil angle α of zero. It should be noted that the height of the turbulence pulse for the turbulation blade 220, corresponding to pulse 233 in FIG. 7, increases for each of the blade positions of FIGS. 10A, 10B, 10C and 10D due to the increases in the in-going angle β of the blade. Thus, the heavy grades of paper sheet require the use of larger in-going angles, while the lighter grades of paper sheet require the use of smaller in-going angles.

Figure 11:
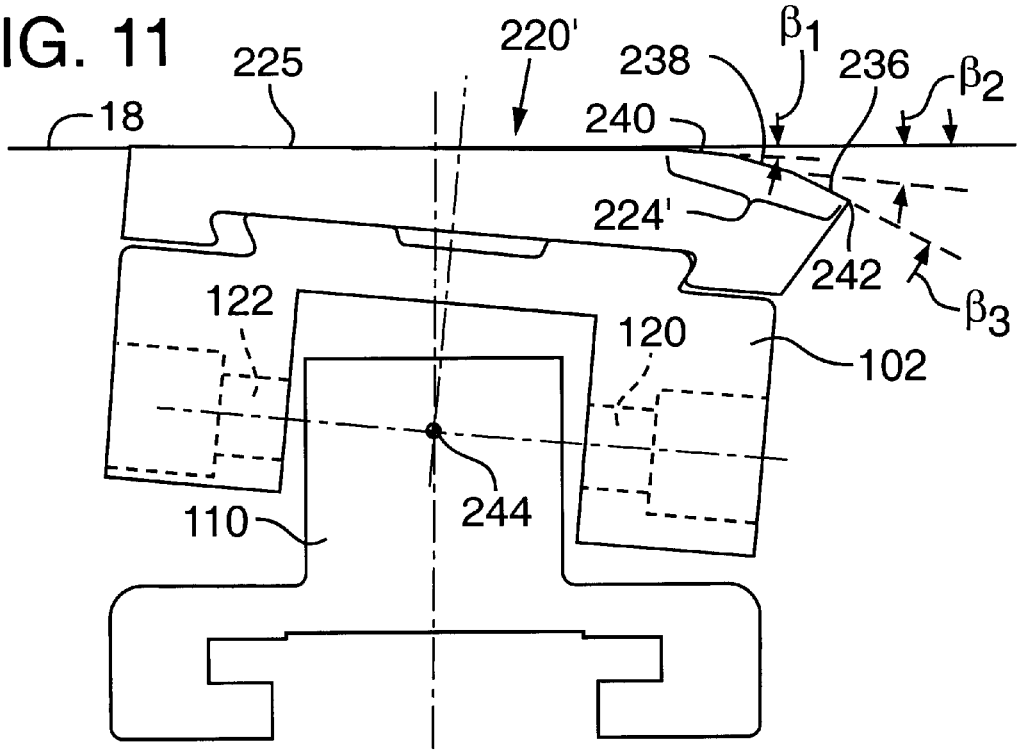
FIG. 11 is a side elevation view of a second embodiment of the turbulation blade of the present invention.

As shown in FIG. 11, a second embodiment of the turbulation blade 220' includes three flat areas 236, 238 and 240 on the leading portion 224' of the upper surface of the blade which are spaced by successively greater amounts rearwardly from a leading edge 242 of such blade. The flat areas 240, 238, and 236, respectively, form three different in-going angles $\beta_1$, $\beta_2$ and $\beta_3$. with the conveyor 18 which are preset to different predetermined angles that may be indicated on the scale 130 for the adjustment shaft 126 of the cam mechanism shown in FIG. 4. The cam mechanism moves the support member 102 and cam follower pins 120 and 122 along the cam surfaces of the cam slots on opposite sides of the base member 110 as shown in FIGS. 4 and 5, to pivot the blade 220' about the pivot axis 244 between the in-going angles $\beta_1$, $\beta_2$ and $\beta_3$. It should be noted that the position of the pivot axis 244 changes vertically with different in-going angles to maintain the height of the foil relative to the conveyor 18 substantially constant.

Figure 10D:
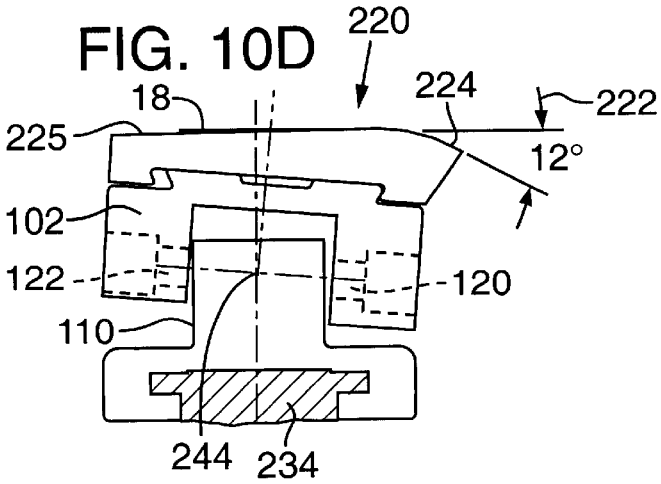
Figure 12:
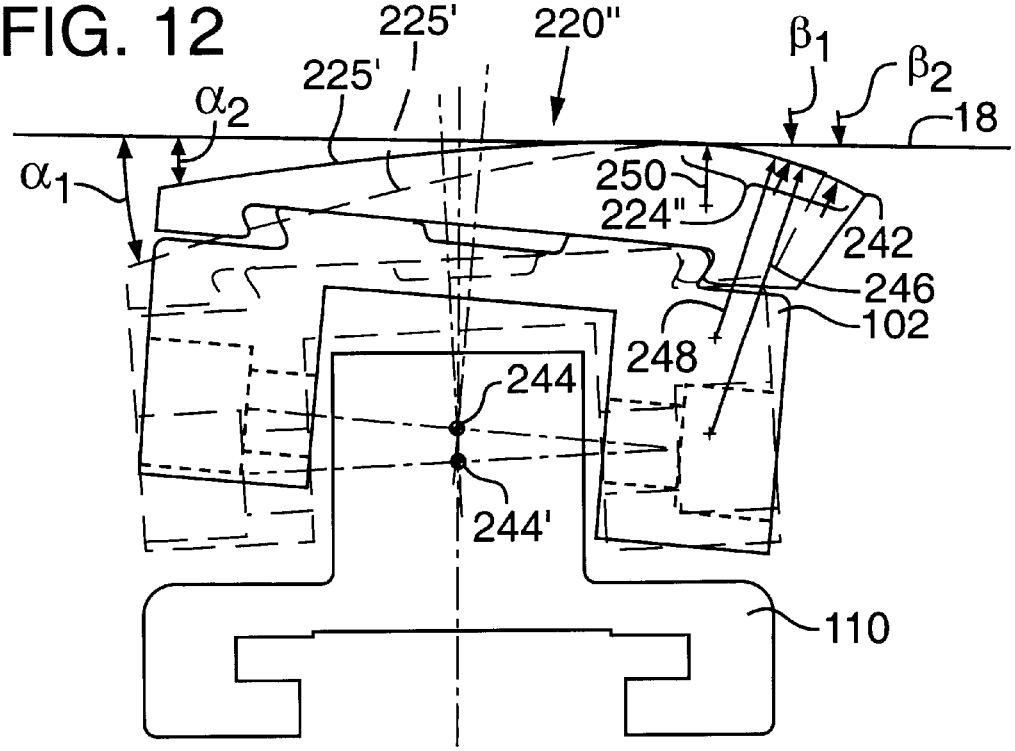
FIG. 12 is a side elevation view of a third embodiment of the turbulation blade of the present invention.

A third embodiment of the turbulation blade 220" is shown in FIG. 12 to include a curved leading portion 224" and a curved trailing portion 225' on the upper surface of such blade. The curved leading portion 224" has three portions of different radius formed by a long first radius 246 for the front portion, a medium-length second radius 248 for the middle portion, and a short third radius 250 for the rear portion of such leading portion. As a result, the leading portion 224" of blade 220" forms different in-going angles β with the conveyor 18 depending upon the pivot position of the blade about pivot axis 244. Thus, in the solid line portion of the blade 220", the leading portion 224" forms an in-going angle $\beta_2$ of about 15 degrees with the conveyor 18, while in the phantom line position of the blade the leading portion forms an in-going angle $\beta_1$, of about 10 degrees, with the conveyor. It should be noted that the pivot axis 244 moves vertically down to position 244' when the blade is pivoted by the cam adjustment mechanism between different in-going angles to maintain the height of the blade substantially constant. Also, the trailing portion 225' of the blade is curved downward to form an angle α of, for example, about 5 degrees with the conveyor at the maximum in-going angle $\beta_2$ of 15 degrees. This curved trailing portion 225' enables a larger maximum in going angle to be used than is possible with a straight trailing portion 225', which limits the rotation portion of the blade, as shown in FIG. 10D. Thus, such a curved tailing portion 225' may also be used on the turbulation blades of FIGS. 8, 10 and 11 to increase the maximum possible in-going angle of such blades.

It will be obvious to those having ordinary skill in the art that many changes may be made in the above described detailed description of certain preferred embodiments thereof. Therefore, the scope of the present invention should only be determined by the following claims.

We claim:

1. Paper stock turbulation apparatus for agitation of paper stock carried on a porous conveyer to form a paper sheet of more uniform consistency on the conveyer, comprising:

a turbulation blade having a variable in-going angle formed between the paper sheet conveyer and a leading portion on the upper surface of the blade;

an adjustment mechanism for moving the blade to different positions to adjust the in-going angle of said blade relative to said conveyer and thereby to control the turbulation of the paper stock on said conveyor as the paper stock is being formed into a paper sheet; and an operating device for operating said adjustment mechanism comprising an electrical operating device which is operated by an automatic control system in response to an output signal of a sensor which senses a characteristic of the paper sheet downstream from the turbulation blade.

2. Apparatus in accordance with claim 1 in which the adjustment mechanism is a cam actuated mechanism which moves the blade to adjust the in-going angle.

3. Apparatus in accordance with claim 2 in which the blade is attached to a support member which is connected to a fixed base member by the cam mechanism for adjusting the support member relative to the base member to vary the in-going angle.

4. Apparatus in accordance with claim 3 in which the cam mechanism includes at least one sloping cam surface on the side of said base member and at least one cam follower on said support member so that said support member and the blade are pivoted relative to the base member as the cam follower travels along the cam surface while the support member is moved along the base member.

5. Apparatus in accordance with claim 1 in which the adjustment mechanism adjusts the in-going angle of the blade while maintaining the height of the blade relative to the conveyer substantially constant.

6. Apparatus in accordance with claim 1 in which the leading portion of the blade includes a plurality of flat surface areas which are spaced along the length of the leading portion and which form different in-going angles with the conveyer.

7. Apparatus in accordance with claim 6 in which the operating device adjusts the blade between different predetermined in-going angles corresponding to the angles of said flat surfaces.

8. Apparatus in accordance with claim 1 in which the leading portion of the blade is curved and includes a plurality of different radii of curvature in successive portions of said leading portion to form different in-going angles with the conveyer at different positions of the blade.

9. Apparatus in accordance with claim 1 in which the blade has a trailing portion on the upper surface of the blade which is curved downward away from the conveyer.

10. Paper stock turbulation apparatus for agitation of paper stock carried on a porous conveyer to form a paper sheet of more uniform consistency on the conveyer, comprising:

a turbulation blade having a variable in-going angle formed between the paper sheet conveyer and a leading portion on the upper surface of the blade;

an adjustment mechanism for moving the blade to different positions to adjust the in-going angle of said blade relative to said conveyer and thereby to control the turbulation of the paper stock on said conveyor as the paper stock is being formed into a paper sheet;

an operating device for operating said adjustment mechanism;

a sensor positioned adjacent to the conveyor downstream from the turbulation blade for sensing a characteristic of the paper sheet and for producing a corresponding sensor output signal; and a controller to control the operating device for automatically adjusting the in-going angle of the blade in accordance with the sensor output signal to change the sensed characteristic of the paper sheet to a desired characteristic.

11. Paper stock turbulation apparatus for agitation of paper stock carried on a porous conveyor to form a paper sheet of more uniform consistency on the conveyor, comprising:

a turbulation blade having a variable in-going angle formed between the paper sheet conveyor and a leading portion on the upper surface of the blade;

a cam actuated adjustment mechanism for moving the blade to different positions to adjust the in-going angle of said blade relative to said conveyor while maintaining the height of the blade relative to the conveyor substantially constant and thereby to control the turbulation of the paper stock on said conveyor as it is being formed into a paper sheet;

an operating device for operating said adjustment mechanism;

a sensor positioned adjacent to the conveyor downstream from the turbulation blade for sensing a characteristic of the paper sheet and for producing a corresponding sensor output signal; and a controller to control the operating device for automatically adjusting the in-going angle of the blade in accordance with the sensor output signal to change the sensed characteristic of the paper sheet to a desired characteristic.

12. Apparatus in accordance with claim 11 in which the leading portion of the blade is curved and includes a plurality of different radii of curvature in successive portions of said leading portion to form different in-going angles with the conveyor at different positions of the blade.

* * * * *